US005996122A

United States Patent [19]

Aldridge et al.

[11] Patent Number: 5,996,122

[45] Date of Patent: Dec. 7, 1999

[54] LIGHTWEIGHT FIREFIGHTER GARMENT

[75] Inventors: Donald Aldridge, New Carlisle; Nicholas J. Curtis, Dayton, both of Ohio

[73] Assignee: Lion Apparel, Inc., Dayton, Ohio

[21] Appl. No.: 09/015,184

[22] Filed: Jan. 29, 1998

[51] Int. Cl.[6] ..... A41D 13/00

[52] U.S. Cl. ..... 2/81; 2/82; 2/87; 2/93; 2/97; 2/457; 2/458

[58] Field of Search ..... 2/81, 82, 85, 87, 2/93, 97, 457, 458

[56] References Cited

U.S. PATENT DOCUMENTS

| | | | |
|---|---|---|---|
| Re. 35,436 | 2/1997 | Grilliot et al. | 2/93 |
| 4,034,417 | 7/1977 | Ellis | 2/81 |
| 4,502,153 | 3/1985 | Lapedes et al. | 2/81 |
| 4,774,725 | 10/1988 | Page | 2/81 |
| 4,843,646 | 7/1989 | Grilliot et al. | 2/69 |
| 5,007,112 | 4/1991 | Lewis, Jr. et al. | 2/79 |
| 5,050,241 | 9/1991 | Flowers et al. | 2/81 |
| 5,127,106 | 7/1992 | Alridge | 2/81 |
| 5,170,506 | 12/1992 | Lewis, Jr. et al. | 2/79 |
| 5,539,928 | 7/1996 | Aldridge | 2/81 |
| 5,542,124 | 8/1996 | Grilliot et al. | 2/81 |
| 5,614,302 | 3/1997 | Nance, Jr. | 442/286 |
| 5,640,718 | 6/1997 | Alridge | 2/81 |
| 5,646,222 | 7/1997 | Maekawa et al. | 526/243 |

*Primary Examiner*—John J. Calvert
*Assistant Examiner*—Gary L. Welch
*Attorney, Agent, or Firm*—Thompson Hine & Flory LLP

[57] ABSTRACT

A firefighting garment including: an outer shell of abrasion, flame and heat resistant material selected from a group consisting of an aramid material, a blend of aramid materials, PBI material, and a blend of aramid and PBI materials; a thermal liner, positioned within the outer shell, the thermal liner including a batting, needlepunch or non-woven aramid material or a blend of such aramid materials stitched to a first face cloth layer of aramid material; and a second face cloth layer of aramid material, positioned within the thermal liner; where the material of the outer shell, the thermal liner, and the second face cloth layer are all treated with a durable, water repellant finish. The firefighting garment does not require a discrete moisture barrier layer, yet possesses the necessary thermal protection ratings for use as a firefighting garment; thus, the firefighting garment is relatively thin and lightweight, thereby minimizing the bulk and reducing the hobbling effect of such a garment, and reducing the material costs of the garment. The firefighting garment substantially reduces the amount of liquid moisture absorbed by the thermal liner, thereby maintaining the insulative properties of the thermal liner and maintaining desirable lightweight properties for longer periods. Further, the firefighting garment enhances the transport of moisture vapor therethrough for breathability and enhanced body-cooling.

39 Claims, 2 Drawing Sheets

LIGHTWEIGHT FIREFIGHTER GARMENT

BACKGROUND

The present invention relates to hazardous duty garments and, more particularly, to lightweight firefighter garments which protect a wearer from extreme ambient conditions.

Protective garments are designed to shield a wearer from a variety of environmental hazards, and firefighter garments are representative of such garments. A conventional firefighting ensemble comprises a turnout coat and pant, each of which includes an outer shell, a moisture barrier located within the outer shell, a thermal liner located within the moisture barrier and an innermost face cloth layer. The outer shell typically is constructed of an abrasion-, flame- and heat-resistant material such as a woven aramid material, typically NOMEX or KEVLAR (both are trademarks of E. I. DuPont de Nemours & Co., Inc.) or a polybenzamidazole such a PBI (a trademark of Celanese Corp.) fiber material. The moisture barrier typically includes a semipermeable membrane layer which is moisture vapor permeable but impermeable to liquid moisture, such as CROSSTECH (a trademark of W. L. Gore & Associates, Inc.). The membrane layer is bonded to a substrate of flame- and heat-resistant material, such as an aramid or PBI material.

The thermal liner is typically positioned within the moisture barrier in order to prevent the thermal liner from soaking up liquid moisture flowing through the outer shell from the ambient. The thermal liner typically comprises a relatively thick layer of aramid fiber batting or needlepunch, often quilted to a lightweight aramid face cloth. The batting of the thermal barrier traps air and possesses sufficient loft to provide the necessary thermal resistance, and the face cloth protects the batting of the thermal liner from abrasion from the wearer.

The aforementioned components typically are arranged within the garment so that the moisture barrier layer is positioned between the thermal liner and the outer shell. This is necessary to prevent the batting material of the thermal liner from absorbing an excessive amount of liquid moisture from the ambient, which increases the overall weight of the garment and reduces breathability of the thermal liner, thereby increasing the stress imposed by the garment on the wearer, and reduces its loft and thermal resistance characteristics. However, one disadvantage with such an arrangement is that the laminated membrane of the moisture barrier is relatively delicate and can be damaged by heat, abrasion or puncture. Such damage results in increased exposure of the thermal liner to liquid moisture, which increases liquid moisture absorption.

Another disadvantage inherent in such an arrangement is that the moisture barrier layer adds to the bulk and weight of the garment and inhibits freedom of movement of the wearer, producing a "hobbling effect," increasing the stress imposed on the wearer in situations requiring high activity, and accelerates the onset of fatigue. Furthermore, with such an ensemble some perspiration moisture vapor from the wearer is absorbed by the thermal liner. Moreover, the combination of a discrete moisture barrier and thermal liner limits breathability, especially if the thermal liner is positioned within the moisture barrier.

Accordingly, there is a need for a protective garment in which the susceptibility of the thermal liner to absorption of perspiration moisture vapor and other moisture vapor is minimized; a protective garment which is relatively thin and lightweight, yet provides adequate thermal protection; a protective garment which is inherently able to withstand a temperature of 500° F. for at least five minutes without igniting, melting or dripping, making it suitable for use as a firefighting garment; and a protective garment which minimizes the restriction of movement and hobbling effect characteristic of conventional firefighting garments.

SUMMARY

The present invention is a protective garment which is relatively lightweight, yet possesses relatively high resistance to liquid water absorption but relatively high moisture vapor transport characteristics when compared to conventional firefighter garments. The garment of the present invention comprises an outer shell, a thermal liner positioned within the outer shell, and a face cloth layer positioned within the thermal liner——a discrete moisture barrier layer is not present or required. At least the outer shell and the face cloth layer are treated with a durable, water repellant finish to reduce penetration of moisture through either of these layers to the thermal liner. Preferably, the thermal liner is also treated with a durable, water repellant finish to minimize liquid moisture absorption. Such durable, water repellant finishes are provided by treating the components with a commercially available perfluorohydrocarbon finish such as TEFLON (a trademark of E. I. DuPont de Nemours & Co., Inc.). and/or SCOTCHGUARD (a trademark of Minnesota Mining & Manufacturing Co.).

In a first embodiment of the present invention, a firefighting garment consists essentially of an outer shell of abrasion-, flame- and heat-resistant material selected from a group consisting of an aramid material, a blend of aramid materials, PBI material and a blend of aramid and PBI materials; a thermal liner positioned within the outer shell and including a batting, needlepunch or nonwoven aramid material, or a blend of such aramid materials, stitched to a first face cloth layer of aramid material; and a second face cloth layer of aramid material, positioned within the thermal liner; where the material of the outer shell, the thermal liner, and the second face cloth layer are all treated with a durable, water repellant finish.

Such a firefighting garment does not require a discrete moisture barrier layer, yet possesses the necessary thermal protection ratings for use as a firefighting garment. Thus, the firefighting garment is relatively thin and lightweight, thereby minimizing the bulk and reducing the hobbling effect of such a garment. Furthermore, the elimination of a discrete moisture barrier reduces the material costs of the garment. The design of the thermal liner substantially reduces the amount of liquid moisture it absorbs, thereby maintaining the insulative properties of the thermal liner and maintaining desirable lightweight properties for longer periods. Another advantage of such a design is that the transport of moisture vapor through the garment is enhanced.

In an alternate embodiment of the present invention, a discrete moisture barrier layer is provided, but is positioned between the treated thermal barrier and the inner face cloth. By providing such a moisture barrier, the penetration of blood-borne pathogens from the environment to the wearer is minimized. Furthermore, the positioning of the treated thermal liner between the outer shell and the moisture barrier protects the moisture barrier from damage from excessive thermal heat and from abrasion caused by the outer shell.

In a second alternate embodiment, a firefighter garment includes an outer shell, a moisture barrier positioned inside and adjacent to the outer shell, a thermal liner positioned inside of the moisture barrier and an inner face cloth. The thermal liner is treated to have a moisture repellant finish as with the other embodiments. The thermal liner of this embodiment thus will absorb only a minimal amount of perspiration moisture from the wearer, from a breach in the moisture barrier or from openings in the neck and sleeve, and generally will be shielded from ambient moisture by the conventional moisture barrier.

Accordingly, it is an object of the present invention to provide a protective garment in which the thermal liner absorbs a minimal amount of liquid moisture; a protective garment which reduces the amount of moisture absorbed by the thermal liner; a protective garment which does not require a discrete moisture barrier layer, yet possesses the necessary thermal protection ratings for use as a firefighting garment; a protective garment which is relatively thin and lightweight, thereby minimizing the bulk and reducing the hobbling effect of such a garment and the reducing the material costs of the garment; and a protective garment that enhances the transport of moisture vapor therethrough for breathability and greater cooling.

Other objects and advantages of the present invention will be apparent from the following description, the accompanying drawings and the appended claims.

DETAILED DESCRIPTION

Figure 1:
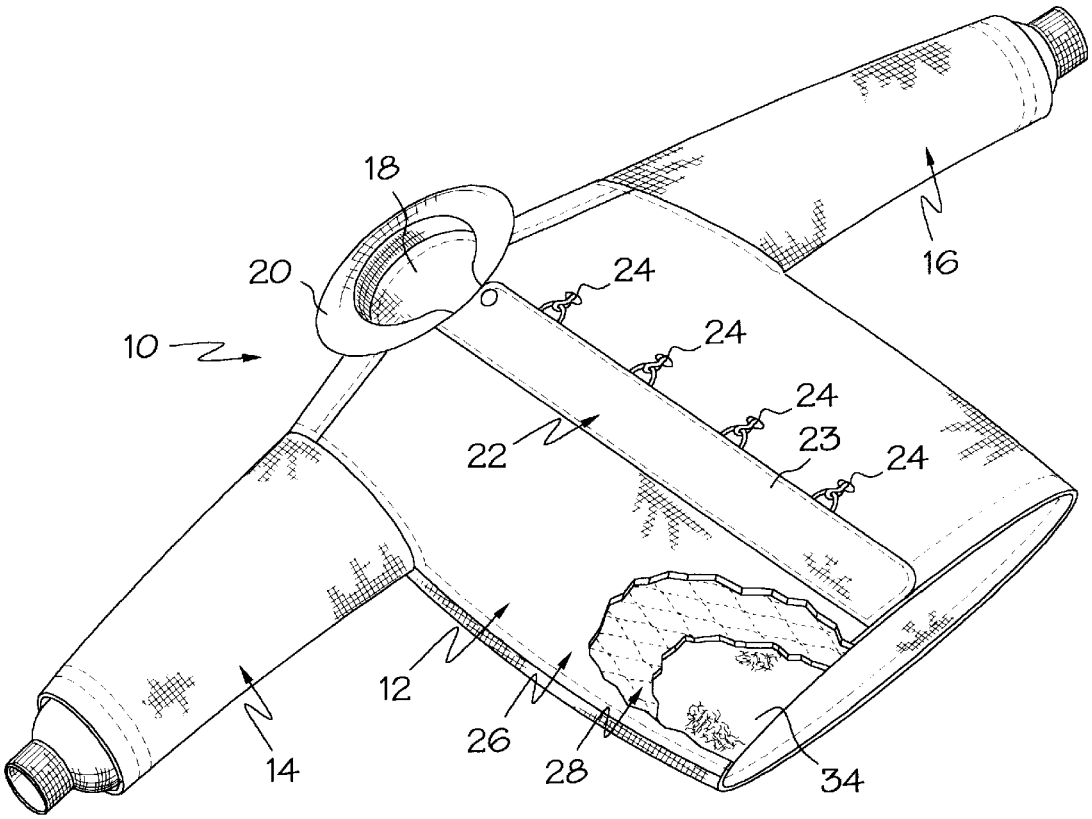
FIG. 1 is a somewhat schematic, perspective view of a firefighter garment incorporating a preferred embodiment of the present invention.

As shown in FIG. 1, the present invention is a protective garment in the form of a firefighter garment, generally designated 10. It is to be understood that the present invention is not limited to firefighter garments, but can be incorporated in work garments and other hazardous duty garments, such as brushfire and EMS garments, in both coat and pant combinations and "jumpsuit" styles, without departing from the scope of the invention. The garment 10 is a firefighter turnout coat having a body portion 12, sleeves 14, 16, a neck opening 18, a collar 20 surrounding the neck opening, and a front closure, generally designated 22. Front closure 22 is of conventional design and includes a storm flap 23. The closure 22 is secured by snaps, or alternatively, strips of hook and loop fastener material (not shown) in combination with mechanical locking means such as hook and "D" combinations 24 extending between the flap 23 and body portion 12, or a slide fastener (not shown).

Figure 2:
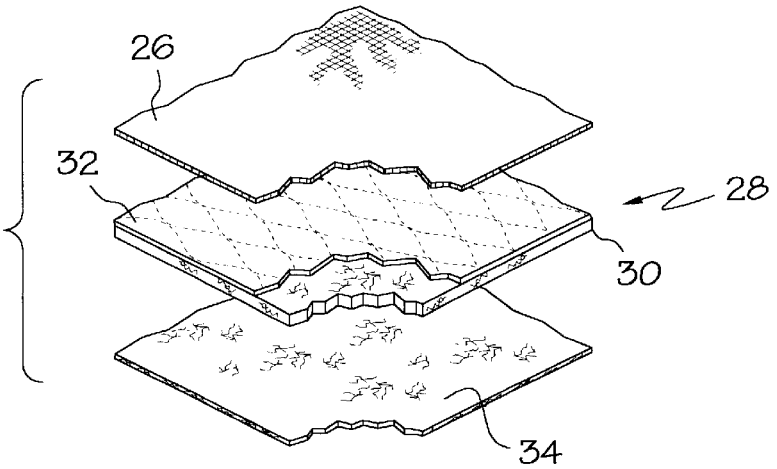
FIG. 2 is an exploded, perspective view of a section of a detail of the garment of FIG. 1.

As shown in FIGS. 1 and 2, the garment 10 includes an abrasion, heat and flame resistant outer shell, generally designated 26, which covers substantially the entire outer surface garment. The outer shell is compact weave of an aramid material such as NOMEX or KEVLAR, a blend of such aramid materials, a PBI material, or a blend of aramid and PBI materials. The thermal liner, generally designated 28, extends substantially throughout the garment 10 and includes layer 30 of insulative material quilted to a layer 32 of aramid face cloth material. The insulation material can be a batting, needlepunch, or multi-layer nonwoven aramid material. A second layer 34 of aramid face cloth material is positioned within the thermal liner 28 and protects the thermal liner from abrasion from the clothing of the wearer. Additionally, it is within the scope of the invention that the foregoing materials may be readily substituted with other materials having similar protective properties, or alternative protective properties corresponding to other specialized hazardous use garments.

The outer shell 26, thermal liner 28 and face cloth layer 34 each are treated with a durable, water-repellant finish prior to assembling these components to form the garment 10. A preferred finish is a perfluorohydrocarbon finish such as TEFLON Fabric Protector. Preferably, a loading of at least 2.5% on weight of fabric of TEFLON is used. A commercially available method for finishing the above components with TEFLON Fabric Protector is provided by E. I. DuPont de Nemours & Co., Inc. of Wilmington, Dela., 19898.

It is within the scope of the invention that other suitable water repellant finishes, coatings or treatments may also be used, such as treating the components with a perfluorohydrocarbon finish such as SCOTCHGUARD, or by applying a silicon, resin, wax or plastic finish. In the preferred embodiment of the invention, each component of the garment 10 possesses certain characteristics which makes it particularly suitable for use in a hazardous duty garment, particularly a firefighter garment. The ensemble of the outer shell 26, thermal liner 28 and face cloth layer 34, each treated with a durable, water-repellant finish according to the invention, meets certain requirements of the N.F.P.A. (National Fire Protection Association) 1971 Standard. Specifically, the ensemble resists igniting, melting or dripping when exposed to 500° F for at least five minutes. Furthermore, the water-repellant finishes applied to the components of the ensemble are durable in that they withstand at least 25 launderings without appreciable diminution in water repellancy.

However, a durability of withstanding at least 5 launderings without appreciable diminution in water repellancy is within the scope of the invention.

Consequently, the firefighting garment 10 does not require a discrete moisture barrier because the water-repellant finish of the outer shell 26 and face cloth layer 34 substantially prevent liquid moisture from reaching and being absorbed by the thermal liner 28. Furthermore, because the thermal liner 28 is also preferably treated with a water-repellant finish, it will be much less susceptible to absorbing and retaining liquid moisture that penetrates through the outer shell 26, face cloth layer 34, or enters through a seam or opening. Additionally, by eliminating a discrete moisture barrier component, the breathability of the garment is increased, and the weight and "hobbling" effect of the garment is substantially decreased.

It is also within the scope of the present invention to use a thermal liner that includes a layer of apertured, closed-cell foam as described in co-pending U.S. Ser. No. 08/596,702 filed Feb. 5, 1996 or U.S. Ser. No. 08/857,092 filed May 15, 1997, the disclosures of which are incorporated herein by reference. Such thermal liners do not absorb significant amounts of liquid moisture and can be made thinner than conventional thermal liners, yet still meet the overall thermal requirements for firefighting garments.

The method of constructing the garment of the present invention is as follows. A relatively lightweight, low volume protective garment is constructed by treating an outer shell of abrasion, flame and heat resistant material with a durable, water-repellant finish; treating a thermal liner with a durable, water-repellant finish; treating a face cloth layer of material with a durable, water-repellant finish; and assembling the garment by positioning the thermal liner within the outer shell and the face cloth layer within the thermal liner. The means for cutting and attaching the various layers together to form the garment will be apparent to those skilled in the art.

Figure 3:
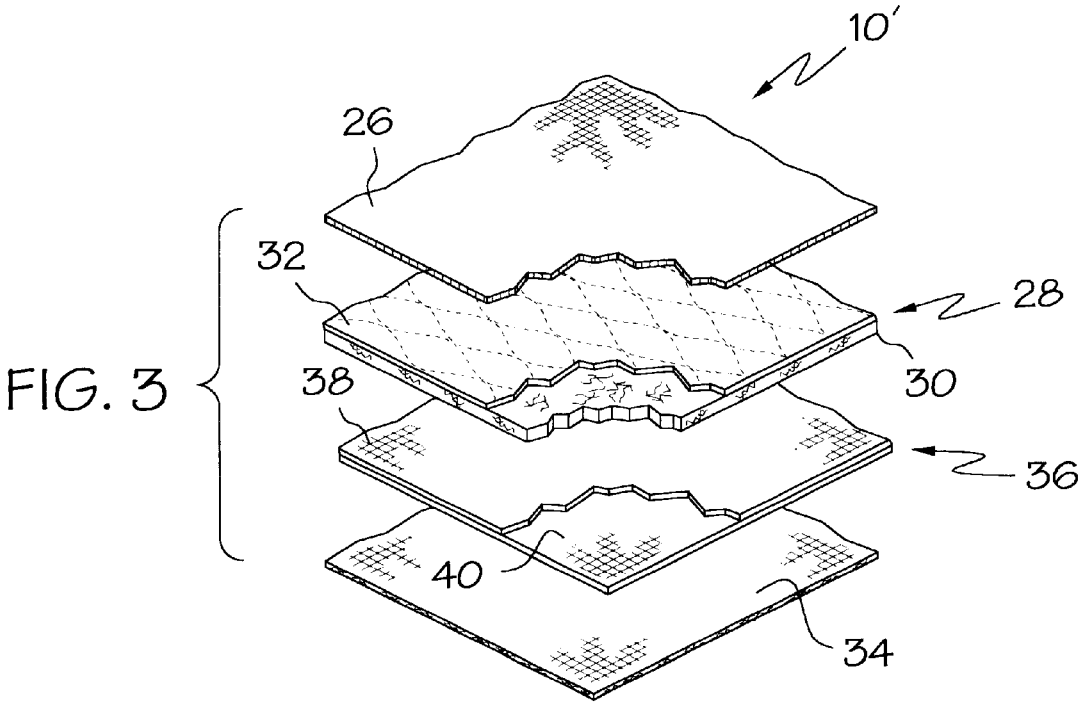
FIG. 3 is an exploded, perspective view of a detail of an alternate embodiment of the present invention.

As shown in FIG. 3, an alternate embodiment 10' of a firefighter garment of the present invention includes a thermal liner 28 adjacent to the outer shell 26 as with the embodiment of FIGS. 1 and 2, but includes a discrete moisture barrier layer 36 between the thermal liner 28 and the face cloth layer 34. The moisture barrier 36 includes a semipermeable membrane layer 38, which is moisture vapor permeable but impermeable to liquid moisture, such as CROSSTECH, bonded to a substrate 40 of flame- and heat-resistant material, such as an aramid or PBI material. By providing such a moisture barrier 36, the penetration of blood-borne pathogens from the environment to the wearer is minimized. Furthermore, the positioning of the thermal liner 28 between the outer shell 26 and the moisture barrier 36 protects the moisture barrier from damage from excessive thermal heat and from abrasion caused by the outer shell. With the embodiment of FIG. 3, the addition of a discrete moisture barrier 36 (as opposed to the water-repellent thermal liner 28 acting also as a moisture barrier for the ensemble) to the ensemble of the outer shell 26, thermal liner and face cloth layer 34, the entire ensemble 10' meets the N.F.P.A. 1971 Standard. Not only does the garment 10' resist burning, melting or dripping when exposed to 500° F for at least five minutes, as does the garment 10 of FIGS. 1 and 2, but the garment passes the liquid penetration test (ASTM test F1359), as well as all other tests comprising the Standard. The treatments applied to the components of the garment 10' of FIG. 3 are also sufficiently durable to withstand at least 5 launderings, and preferably at least 25 launderings.

Figure 4:
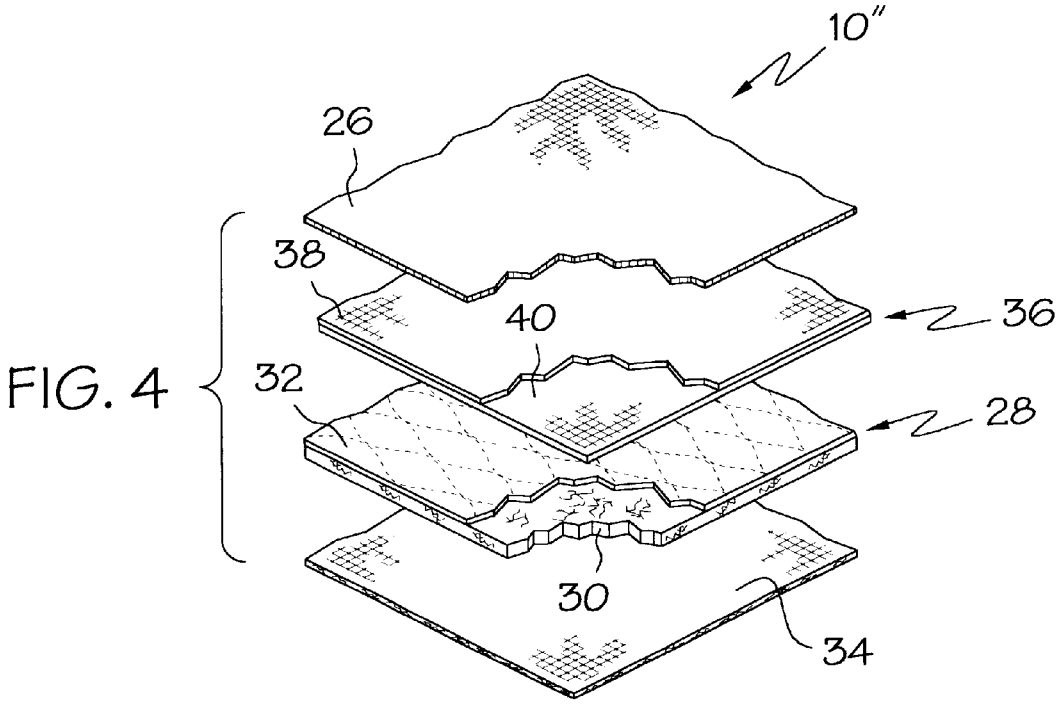
FIG. 4 is an exploded, perspective view of a detail of a second alternate embodiment of the invention.

As shown in FIG. 4, in another alternate embodiment 10" of the garment of the present invention, the moisture barrier 36 is positioned adjacent to the outer shell 26, and the thermal liner 28 is positioned in between the moisture barrier and the face cloth layer 34. With this embodiment, the moisture barrier 36 protects the durable, moisture-resistant thermal liner 28 from liquid moisture penetrating the outer shell 26. The advantage of utilizing the moisture resistant thermal liner 28 of the present invention in this embodiment is that the moisture resistance of the thermal liner minimizes its absorption of liquid perspiration from a wearer, as well as absorption of liquid moisture from wicking from sleeve and neck openings or from a small tear in the moisture barrier.

Furthermore, the garment 10" of FIG. 4 meets the N.F.P.A. 1971 Standard. In particular, the garment 10" resists igniting, melting or dripping when exposed to 500° F for at least five minutes, passes the liquid penetration test, and passes all other tests comprising the Standard. While in the preferred form of the embodiment of the garment 10" the outer shell 26, thermal liner 28 and face cloth layer 24 are each treated to have the durable, water-repellent finish described with respect to the garment 10, the garment 10" can be modified such that the face cloth layer 34 is not treated with the durable finish.

While the forms of apparatus herein described constitute preferred embodiments of this invention, it is to be understood that the invention is not limited to these precise forms of apparatus, and that changes may be made therein without departing from the scope of the invention.

What is claimed is:

1. A protective garment comprising:

an outer shell treated with a durable, water-repellant finish;

a thermal liner, positioned between the outer shell and a wearer of the garment; and a first face cloth layer treated with a durable, water-repellant finish and positioned between the thermal liner and a wearer of the garment, such that said outer shell and said face cloth layer cooperate to minimize an amount of liquid moisture absorbed by said thermal liner from said outer shell and face cloth layer.

2. The protective garment of claim 1 wherein the thermal liner is treated with a durable, water-repellant finish.

3. The protective garment of claim 2 wherein the durable, water repellant finish includes a perfluorohydrocarbon finish.

4. The protective garment of claim 1 wherein the durable, water repellant finish includes a perfluorohydrocarbon finish.

5. A firefighting garment having at least a portion consisting essentially of:

an outer shell of abrasion, flame and heat resistant material selected from a group consisting of an aramid material, a blend of aramid materials, a polybenzamidazole material, and a blend of aramid and polybenzamidazole materials;

a thermal liner, positioned between the outer shell and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material; and a face cloth layer of aramid material, positioned between the thermal liner and a wearer of the garment;

the material of the outer shell and the material of the face cloth layer being treated with a durable, water-repellant perfluorohydrocarbon finish, such that said outer shell and said face cloth layer cooperate to minimize an amount of liquid moisture absorbed by said thermal liner from said outer shell and face cloth layer.

6. The section of a firefighting garment of claim 5 wherein said thermal liner is treated with a durable, water-repellant perfluorohydrocarbon.

7. A firefighting garment comprising:

an outer shell of abrasion, flame and heat resistant material selected from a group consisting of an aramid material, a blend of aramid materials, a polybenzamidazole material, and a blend of aramid and polybenzamidazole materials;

a thermal liner, positioned between the outer shell and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material, and the thermal liner being stitched to a first face cloth layer of aramid material; and a second face cloth layer of aramid material, positioned between the thermal liner and a wearer of the garment;

the material of the outer shell, the material of the thermal liner, and the material of the second face cloth layer being treated with a durable, water-repellant finish.

8. The protective garment of claim 7 wherein the durable, water repellant finish includes a perfluorohydrocarbon finish.

9. A firefighting garment comprising:

an outer shell of abrasion, flame and heat resistant material selected from a group consisting of an aramid material, a blend of aramid materials, a polybenzamidazole material, and a blend of aramid and polybenzamidazole materials;

a discrete moisture barrier positioned between the outer shell and a wearer of the garment;

a thermal liner positioned between the moisture barrier and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material, and the thermal liner being stitched to a first face cloth layer of aramid material;

a second face cloth layer positioned between the thermal liner and a wearer of the garment; and the material of the outer shell, thermal liner, and second face cloth layer being treated with a durable, water-repellant finish.

10. The protective garment of claim 9, wherein the durable, water repellant finish includes a perfluorohydrocarbon finish.

11. A firefighting garment comprising:

an outer shell of abrasion, flame and heat resistant material;

a thermal liner positioned between the outer shell and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material, and the thermal liner being stitched to a face cloth layer of aramid material;

a discrete moisture barrier positioned between the thermal liner and a wearer of the garment; and a second face cloth layer positioned between the moisture barrier and a wearer of the garment;

the material of the thermal liner being treated with a durable, water-repellant finish whereby the moisture barrier is protected from damage from ambient heat and from abrasion with the outer shell by the thermal liner.

12. The firefighting garment of claim 11 wherein the finish includes a perfluorohydrocarbon finish.

13. The firefighting garment of claim 11 wherein the outer shell is treated with a durable, water-repellant finish.

14. The firefighting garment of claim 12 wherein the second face cloth layer is treated with a durable, water-repellant finish.

15. A firefighting garment comprising:

an outer shell of abrasion, flame and heat resistant material;

a discrete moisture barrier positioned between the outer shell and a wearer of the garment;

a thermal liner positioned between the outer shell and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material, and the thermal liner being stitched to a face cloth layer of aramid material; and a second face cloth layer positioned between the moisture barrier and a wearer of the garment;

the material of the thermal liner being treated with a durable, water-repellant finish.

16. The firefighting garment of claim 15 wherein the finish includes a perfluorohydrocarbon finish.

17. The firefighting garment of claim 15 wherein the outer shell is treated with a durable, water-repellant finish.

18. The firefighting garment of claim 17 wherein the finish on the outer shell includes a perfluorohydrocarbon finish.

19. The firefighting garment of claim 18 wherein the second face cloth layer is treated with a durable, water-repellant finish.

20. The firefighter garment of claim 19 wherein the finish on the second face cloth layer includes a perfluorohydrocarbon finish.

21. A method of constructing a relatively lightweight, low volume protective garment comprising the steps of:

treating an outer shell of abrasion, flame and heat resistant material with a durable, water-repellant finish, the outer shell having an inner side and an outer side;

treating a thermal liner with a durable, water-repellant finish, the thermal line having an inner side and an outer side;

obtaining a face cloth layer of material;

assembling the garment by positioning the thermal liner on the inner side of the outer shell and the face cloth layer on the inner side of the outer shell.

22. The method of claim 21, wherein the thermal liner treating step includes the step of applying a finish of perfluorohydrocarbon to the thermal liner.

23. The method of claim 21 further comprising the step of positioning a discrete moisture barrier on the inner side of the outer shell and the thermal liner adjacent to an inner side of the moisture barrier.

24. The method of claim 23 wherein the face cloth layer is positioned on the inner side of the thermal liner.

25. The method of claim 21 wherein the obtaining step includes the step of applying a finish of perfluorohydrocarbon to the face cloth layer of material.

26. The method of claim 21 wherein the treating step includes the step of applying a finish of perfluorohydrocarbon to the outer shell.

27. A protective garment comprising:

an outer shell treated with a durable, water-repellant finish;

a thermal liner, positioned between the outer shell and a wearer of the garment and treated with a durable water-repellant finish; and a first face cloth layer treated with a durable water-repellant finish and positioned between the thermal liner and a wearer of the garment, such that said outer shell and said face cloth layer cooperate to minimize an amount of liquid moisture absorbed by said thermal liner from said outer shell and face cloth layer;

the water repellant finish including a perfluorohydrocarbon finish; and the thermal liner including a second face cloth layer attached thereto.

28. A protective garment comprising:

an outer shell treated with a durable, water-repellant finish;

a thermal liner including a layer of apertured, heat- and flame-resistant closed-cell foam material, positioned between the outer shell and a wearer of the garment; and a first face cloth layer treated with a durable, water-repellant finish and positioned between the thermal liner and a wearer of the garment, such that said outer shell and said face cloth layer cooperate to minimize an amount of liquid moisture absorbed by said thermal liner from said outer shell and face cloth layer.

29. A method of constructing a relatively lightweight, low volume protective garment comprising the steps of:

treating an outer shell of abrasion, flame and heat resistant material with a durable, water-repellant finish, the outer shell having an inner side and an outer side;

treating a thermal liner with a durable, water-repellant finish, the thermal liner having an inner side and an outer side;

obtaining a face cloth layer of material;

assembling the garment by positioning the thermal liner on the inner side of the outer shell and the face cloth layer on the inner side of the outer shell; and positioning a discrete moisture barrier on the inner side of the thermal liner, whereby the moisture barrier is protected from damage from ambient heat and abrasion from the outer shell by the thermal liner.

30. A firefighting garment comprising:

an outer shell of abrasion, flame and heat resistant material;

a discrete moisture barrier positioned between the outer shell and a wearer of the garment; and a thermal liner positioned between the moisture barrier and a wearer of the garment, the thermal liner being selected from a group consisting of an aramid needlepunch material, an aramid batting material, an aramid nonwoven material, an aramid-blend needlepunch material, an aramid-blend batting material and an aramid-blend nonwoven material, and the thermal liner being stitched to a face cloth layer of aramid material;

the moisture barrier including a substrate of flame- and heat-resistant material; and the material of the thermal liner being treated with a durable, water-repellant finish.

31. The firefighting garment of claim 30 wherein the face cloth layer is treated with a durable water repellant finish.

32. The firefighting garment of claim 30 wherein the moisture barrier includes a semipermeable membrane layer attached to the substrate of flame- and heat-resistant material.

33. The firefighting garment of claim 30 further comprising a second face cloth layer positioned between the thermal liner and a wearer of the garment.

34. A hazardous duty garment comprising:

an outer shell;

a thermal liner positioned between the outer shell and a wearer of the garment, the thermal liner being attached to a first face cloth layer; and a second face cloth layer positioned between the thermal liner and a wearer of the garment;

the outer shell, thermal liner, first face cloth layer and second face cloth layer being treated with a durable, water-repellant finish.

35. A hazardous duty garment comprising:

an outer shell;

a discrete moisture barrier positioned between the outer shell and a wearer of the garment;

a thermal liner positioned between the moisture barrier and a wearer of the garment, the thermal liner being attached to a first face cloth layer; and a second face cloth layer positioned between the thermal liner and first face cloth layer and a wearer of the garment;

the outer shell, thermal liner and first face cloth layer being treated with a durable, water-repellant finish.

36. A firefighter garment comprising:

an outer shell;

a moisture barrier positioned between the outer shell and a wearer of the garment and adjacent to the outer shell;

a thermal liner positioned between the moisture barrier and a wearer of the garment; and a face cloth layer positioned between the thermal liner and a wearer of the garment;

the thermal liner being treated with a durable, water-repellant finish.

37. The hazardous duty garment of claim 36 wherein the finish on the thermal liner includes a perfluorohydrocarbon finish.

38. The hazardous duty garment of claim 36 wherein the moisture barrier includes a semipermeable membrane layer attached to a substrate of flame- and heat-resistant material.

39. The hazardous duty garment of claim 36 wherein the face cloth layer is treated with a durable, water-repellant finish.

* * * * *